US012235060B2

(12) United States Patent
Schoenfeld

(10) Patent No.: US 12,235,060 B2
(45) Date of Patent: Feb. 25, 2025

(54) FIXED AMMUNITION FEEDING DEVICE

(71) Applicant: Josh Allen Schoenfeld, San Clemente, CA (US)

(72) Inventor: Josh Allen Schoenfeld, San Clemente, CA (US)

( * ) Notice: Subject to any disclaimer, the term of this patent is extended or adjusted under 35 U.S.C. 154(b) by 100 days.

(21) Appl. No.: 17/890,643

(22) Filed: Aug. 18, 2022

(65) Prior Publication Data

US 2023/0053485 A1 Feb. 23, 2023

Related U.S. Application Data

(60) Provisional application No. 63/234,588, filed on Aug. 18, 2021.

(51) Int. Cl.
*F41A 17/38* (2006.01)
*F41A 9/59* (2006.01)
*F41A 9/67* (2006.01)

(52) U.S. Cl.
CPC ..... *F41A 17/38* (2013.01); *F41A 9/59* (2013.01); *F41A 9/67* (2013.01)

(58) Field of Classification Search
CPC ..... F41A 9/66; F41A 9/69; F41A 9/70; F41A 11/00; F41A 9/65; F41A 9/24; F41A 9/25; F41A 9/61; F41A 9/62; F41A 9/00; F41A 9/59; F41A 9/67; F41A 15/00; F41A 15/16; F41A 17/00; F41A 17/38
USPC ..... 42/50, 49.01, 7, 49.02, 6
See application file for complete search history.

(56) References Cited

U.S. PATENT DOCUMENTS

| | | | | |
|---|---|---|---|---|
| 2,363,772 | A * | 11/1944 | Browning | F41A 3/68 89/138 |
| 2,657,489 | A * | 11/1953 | Robertson, Jr. | F41A 9/65 42/6 |
| 7,497,044 | B2 * | 3/2009 | Cammenga | F41A 9/67 42/50 |
| 8,104,209 | B1 * | 1/2012 | Bentley | F41A 9/59 42/6 |
| 9,605,918 | B1 * | 3/2017 | Ballard | F41A 9/65 |
| 10,527,374 | B1 * | 1/2020 | August | F41A 9/66 |
| 11,650,022 | B2 * | 5/2023 | Rodriguez | F41A 17/38 42/49.01 |
| 2014/0317980 | A1 * | 10/2014 | Michel | F41A 17/06 42/84 |
| 2018/0364003 | A1 * | 12/2018 | Henderson | F41A 9/65 |
| 2023/0070228 | A1 * | 3/2023 | Kellgren | F41A 9/65 |

* cited by examiner

*Primary Examiner* — Michael D David

(57) ABSTRACT

An ammunition feeding device is disclosed. The ammunition feeding device comprises a body, a follower inside the body, a magazine spring contacting the follower, and a spring latch attached to the body, where the spring latch extends from a position inside the body to a position outside the body through an opening in the top of the body.

15 Claims, 6 Drawing Sheets

FIXED AMMUNITION FEEDING DEVICE

CROSS-REFERENCE TO RELATED APPLICATIONS

This application claims the benefit of U.S. Provisional Application No. 63/234,588, filed Aug. 18, 2021.

FIELD OF THE INVENTION

This disclosure relates in general, but not by way of limitation, to a fixed ammunition feeding device, and more particularly to an insertable fixed ammunition feeding device.

BACKGROUND OF THE INVENTION

Many types of ammunition feeding devices, or magazines, are available for modern firearms. These magazines are available in a variety of capacities, materials, and designs. Most of these are removable by depressing a magazine release button on the firearms to remove an empty magazine and replace it with a new one. Users normally carry a quantity of the magazines to support the ammunition needs of the firearm.

BRIEF SUMMARY OF THE INVENTION

One inventive aspect is an ammunition feeding device. The ammunition feeding device comprises a body, a follower inside the body, a magazine spring contacting the follower, and a spring latch attached to the body, where the spring latch extends from a position inside the body to a position outside the body through an opening in the top of the body.

DETAILED DESCRIPTION OF THE INVENTION

Particular embodiments of the invention are illustrated herein in conjunction with the drawings. Direction terms, up, down, left, right, etc., when used, are understood to mean the directions implied by the combination of the context of the usage and the orientation illustrated in the relevant drawings, and/or as understood by those of skill in the art before and/or after understanding various aspects of the present disclosure.

Various details are set forth herein as they relate to certain embodiments. However, the invention can also be implemented in ways which are different from those described herein. Modifications can be made to the discussed embodiments by those skilled in the art without departing from the invention. Therefore, the invention is not limited to particular embodiments disclosed herein.

The fixed magazine of this application is locked into the weapon. For example, once the magazine is fully seated in the magazine well of the firearm, a spring latch may automatically deploy and secure the magazine in place.

Figure 1:
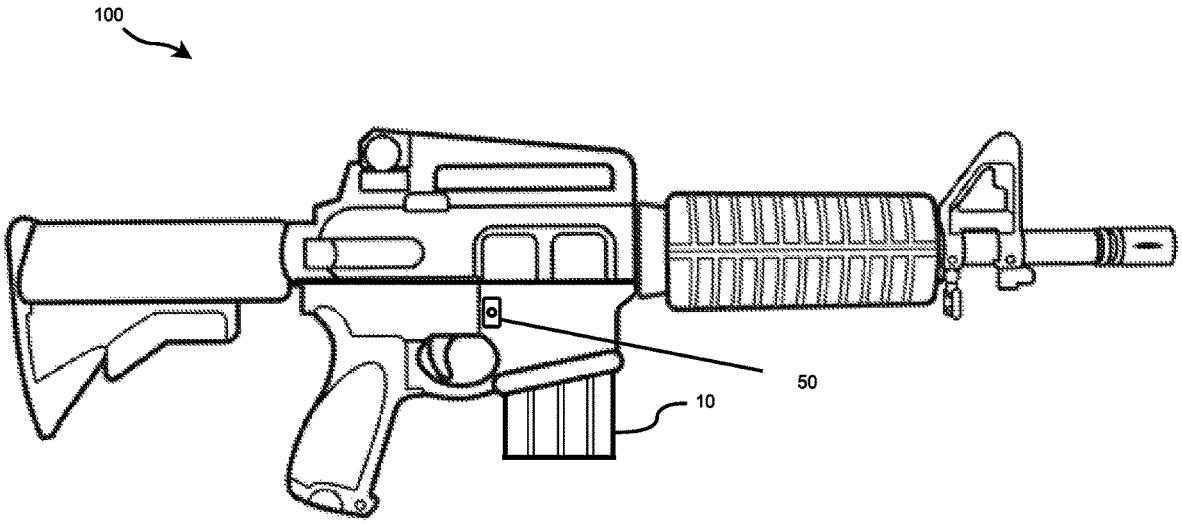
FIG. 1 is a schematic illustration of a firearm having a magazine attached thereto according to some embodiments.

FIG. 1 is a schematic illustration of a firearm 100 having a magazine 10 attached thereto according to some embodiments. In the illustrated embodiment, firearm 100 is an AR-15 or an AR-15 type weapon. For example, firearm 100 may have features, functions, and components similar or identical to AR-15 or AR-15 type weapons, as understood by those of skill in the art before and/or after understanding various aspects of the present disclosure. The inventive principles and aspects discussed herein may be applied to other types of weapons.

Firearm 100 includes a lower receiver, discussed below, which includes a receptacle or a magazine well configured to receive magazine 10, as illustrated. In the illustrated configuration, firearm 100 has magazine 10 inserted into the magazine well of firearm 100 such that magazine 10 is attached to firearm 100 by a retention mechanism, not shown. The retention mechanism is configured to retain magazine 10 attached to firearm 100.

Firearm 100 also includes magazine release mechanism 50, which is connected to the magazine retention mechanism. Magazine release mechanism 50 is operably configured to control the magazine retention mechanism such that, when activated, magazine release mechanism 50 causes the magazine retention mechanism to release or no longer retain magazine 10. In some embodiments, magazine release mechanism 50 includes a button which may be pressed by an operator of firearm 100 using, for example, a hand, a finger, or a tool to release magazine 10 from firearm 100, as understood by those of skill in the art before and/or after understanding various aspects of the present disclosure.

Figure 2:
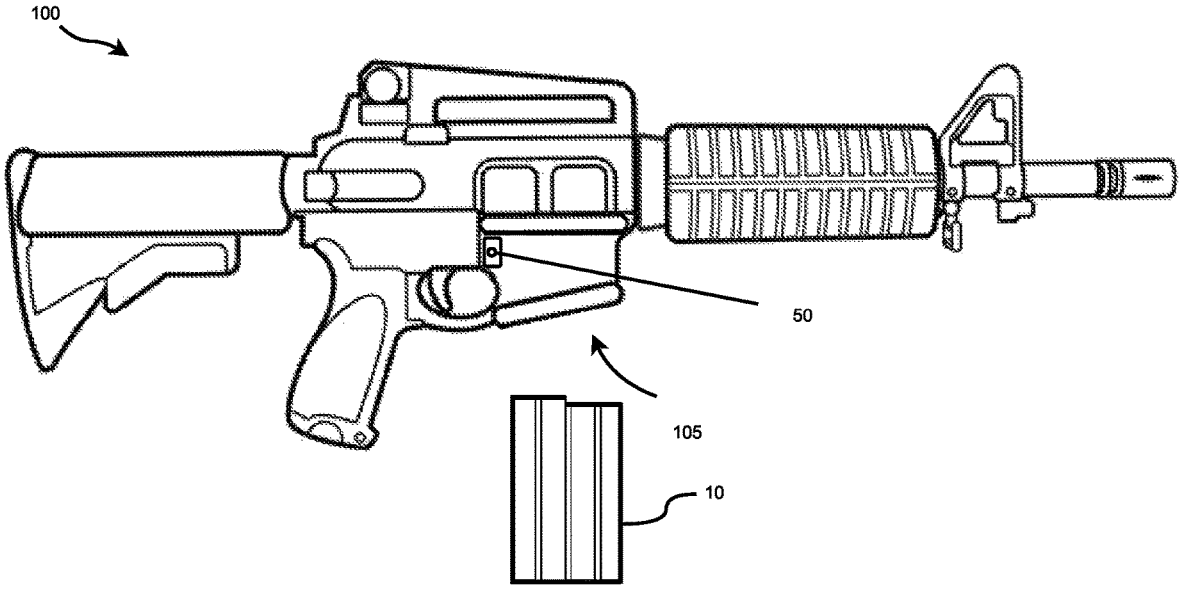
FIG. 2 is a schematic illustration of a firearm having a magazine detached therefrom according to some embodiments.

FIG. 2 is a schematic illustration of firearm 100 having magazine 10 detached therefrom according to some embodiments. For example, the operator of firearm 100 may activate magazine release mechanism 50 to cause magazine 10 to detach and drop from the magazine well 105 of firearm 100, for example as illustrated.

Figure 3:
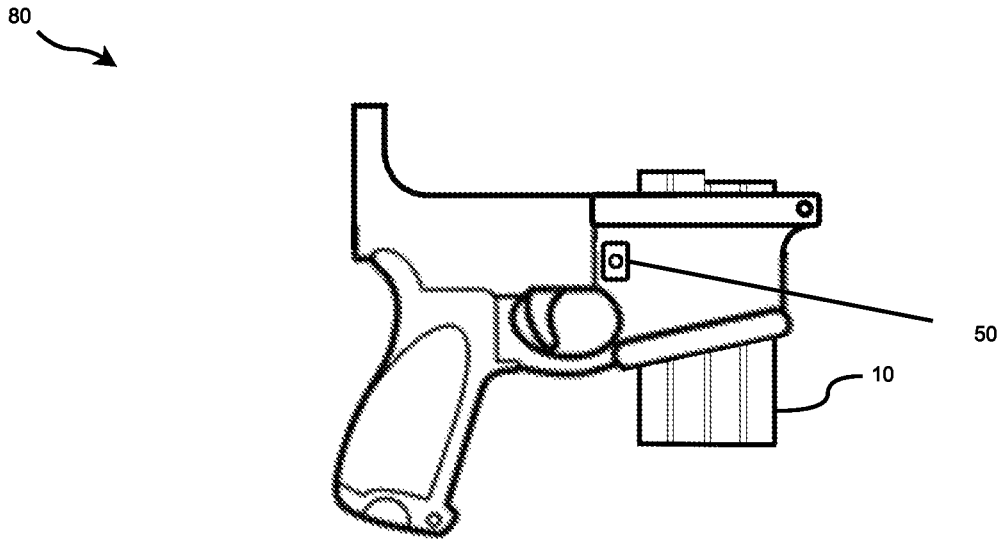
FIG. 3 is a schematic illustration of lower receiver of a firearm having a magazine attached thereto according to some embodiments.

FIG. 3 is a schematic illustration of lower receiver 80 of firearm 100 having magazine 10 attached thereto according to some embodiments. In the illustrated embodiment, lower receiver 80 is an AR-15 or an AR-15 type lower receiver. For example, lower receiver 80 may have features, functions, and components similar or identical to AR-15 or AR-15 type lower receivers, as understood by those of skill in the art before and/or after understanding various aspects of the present disclosure.

Lower receiver 80 includes includes a receptacle or a magazine well configured to receive magazine 10, as illustrated. In the illustrated configuration, lower receiver 80 has magazine 10 inserted into the magazine well of lower receiver 80 such that magazine 10 is attached to lower receiver 80 by a retention mechanism, not shown. The retention mechanism is configured to retain magazine 10 attached to lower receiver 80.

Lower receiver 80 also includes magazine release mechanism 50, which is connected to the magazine retention mechanism. Magazine release mechanism 50 is operably configured to control the magazine retention mechanism such that, when activated, magazine release mechanism 50 causes the magazine retention mechanism to release or no longer retain magazine 10. In some embodiments, magazine release mechanism 50 includes a button which may be pressed by an operator of lower receiver 80 using, for example, a hand, a finger, or a tool to release magazine 10 from lower receiver 80, as understood by those of skill in the art before and/or after understanding various aspects of the present disclosure.

Figure 4:
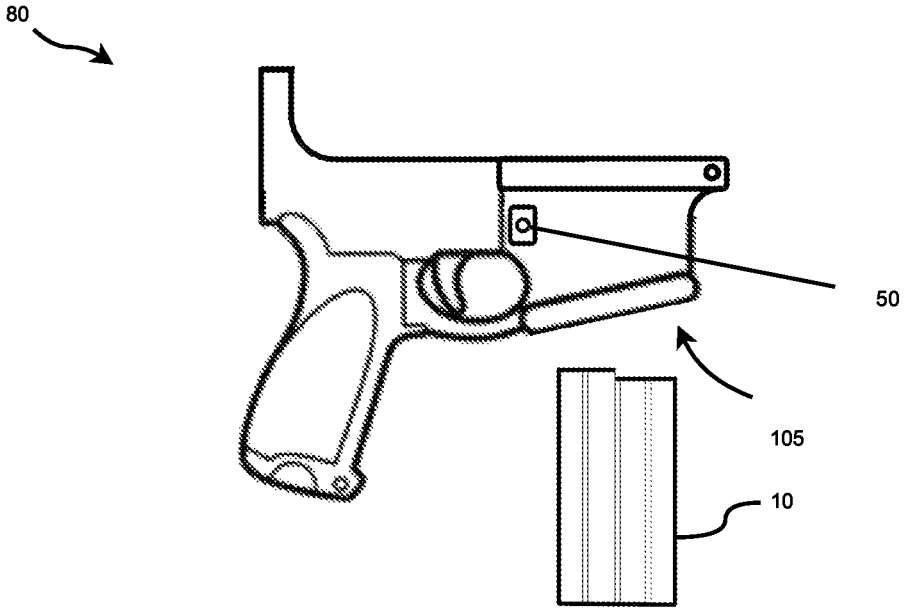
FIG. 4 is a schematic illustration of a lower receiver of a firearm having a magazine detached therefrom according to some embodiments.

FIG. 4 is a schematic illustration of lower receiver 80 having magazine 10 detached therefrom according to some embodiments. For example, the operator of lower receiver 80 may activate magazine release mechanism 50 to cause magazine 10 to detach and drop from the magazine well 105 of lower receiver 80, for example as illustrated.

Figure 5:
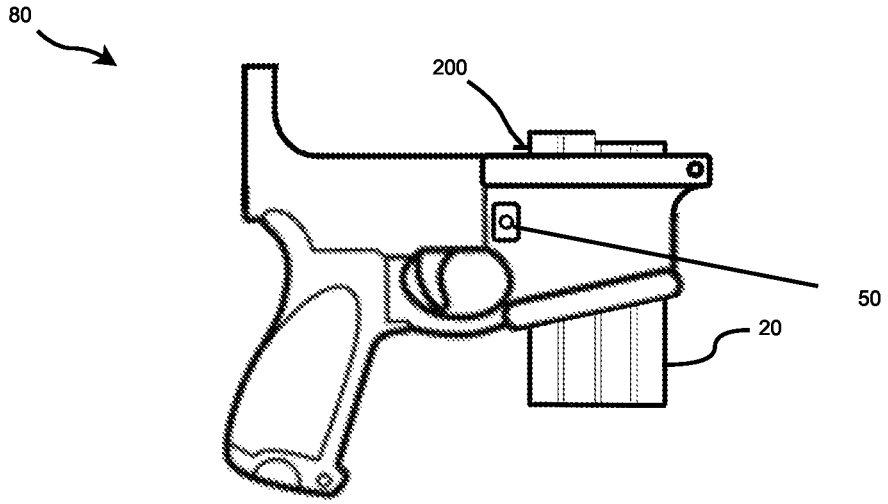
FIG. 5 is a schematic illustration of lower receiver of a firearm having a magazine attached thereto according to some embodiments.

FIG. 5 is a schematic illustration of lower receiver 80 of firearm 100 having magazine 20 attached thereto according to some embodiments.

In the illustrated configuration, lower receiver 80 has magazine 20 inserted into the magazine well of lower receiver 80 such that magazine 20 is attached to lower receiver 80 by spring latch 200, discussed in further detail below. The illustrated portion of spring latch 200 is configured to engage lower receiver 80 such that as a result of magazine 20 being inserted into the magazine well of lower receiver 80, the illustrated portion of spring latch 200 engages a portion of lower receiver 80. As a consequence of the illustrated portion of spring latch 200 engaging the portion of lower receiver 80, magazine 20 becomes fixed to lower receiver 80. Accordingly, magazine 20 cannot be removed from lower receiver 80 without accessing and manipulating the illustrated portion of spring latch 200.

In some embodiments, lower receiver 80 has magazine 20 inserted into the magazine well of lower receiver 80 such that magazine 20 is attached to lower receiver 80 by the retention mechanism of lower receiver 80, not shown.

In some embodiments, lower receiver 80 additionally has magazine 20 inserted into the magazine well of lower receiver 80 such that magazine 20 is not attached to lower receiver 80 by the retention mechanism of lower receiver 80, not shown. For example, in some embodiments, magazine 20 does not have mechanical or topological features which engage with the magazine retention mechanism of lower receiver 80, such that the magazine retention mechanism is ineffective and does not function to retain magazine 20 in the magazine well of lower receiver 80. For example, some conventional magazines include an edge in their outer portions which engage the magazine retention mechanism of lower receivers, such that, when inserted in the magazine well of the lower receivers, the magazine retention mechanism engages the edge to cause the conventional magazines to be retained. In some embodiments, magazine 20 does not have such an edge. Consequently, the magazine retention mechanism of lower receiver 80 does not retain magazine 20 when inserted in the magazine well of lower receiver 80. In some embodiments, the edge is effectively omitted by forming the magazine 20 without a gap or hole or cavity or protrusion formed in conventional magazines and which result in the magazine retention mechanism retaining the conventional magazine when inserted into the magazine well.

Lower receiver 80 also includes magazine release mechanism 50, which is connected to the magazine retention mechanism. Magazine release mechanism 50 is operably configured to control the magazine retention mechanism such that, when activated, in some embodiments of magazine 20, magazine release mechanism 50 causes the magazine retention mechanism to release or no longer retain magazine 20. In some embodiments, magazine release mechanism 50 includes a button which may be pressed by an operator of lower receiver 80 using, for example, a hand, a finger, or a tool to release such embodiments of magazine 20 from lower receiver 80, as understood by those of skill in the art before and/or after understanding various aspects of the present disclosure.

Figure 6:
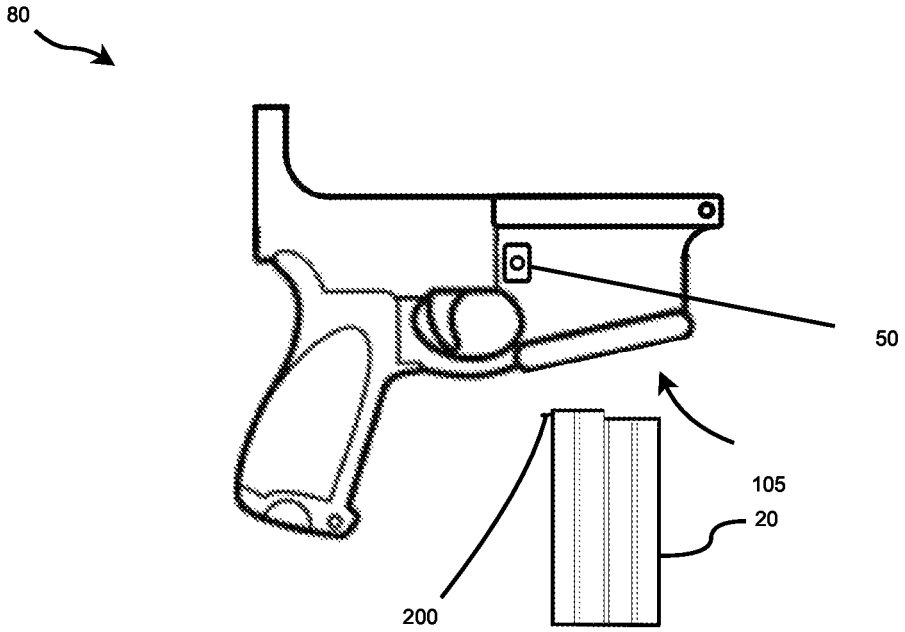
FIG. 6 is a schematic illustration of a lower receiver of a firearm having a magazine detached therefrom according to some embodiments.

FIG. 6 is a schematic illustration of lower receiver 80 having magazine 20 detached therefrom according to some embodiments. For example, the operator of lower receiver 80 may access and manipulate spring latch 200 to cause the illustrated portion of spring latch 200 to disengage from the portion of lower receiver 80. In some embodiments, the operator additionally activates magazine release mechanism 50 to cause magazine 20 to detach and drop from the magazine well 105 of lower receiver 80, for example as illustrated.

Figure 7:
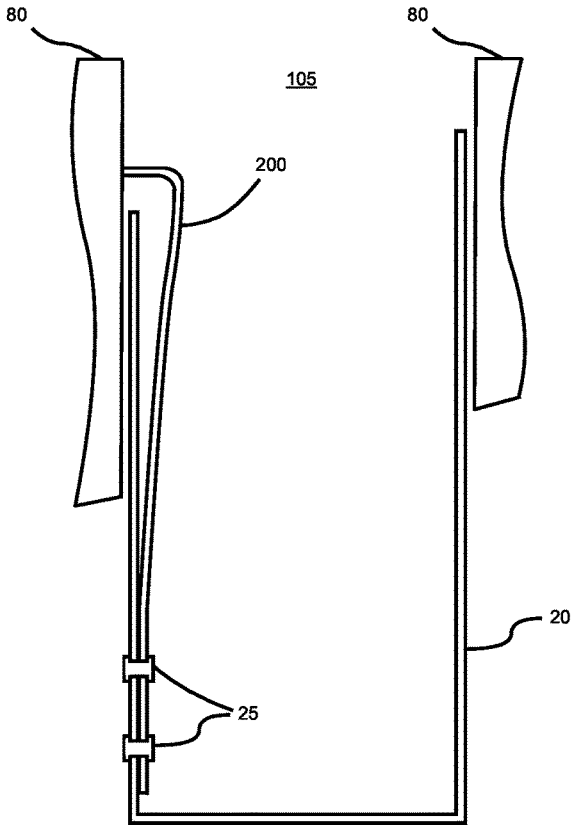
FIG. 7 is a cross-sectional view of a magazine well of a lower receiver having a magazine partially inserted therein according to some embodiments.

FIG. 7 is a cross-sectional view of magazine well 105 of lower receiver 80 of firearm 100 having magazine 20 partially inserted therein according to some embodiments. For clarity, magazine 20 is illustrated without a follower and a magazine spring, which are discussed below with reference to FIG. 14.

As illustrated, the spring latch 200 of magazine 20 is attached to the rest of magazine 20 by attachment mechanisms 25. In some embodiments, attachment mechanisms 25 comprise at least one of rivets, screws, welds, adhesives, and/or another mechanism.

At the illustrated amount of insertion, the top portion of magazine 20 is partially inserted into the magazine well 105, and magazine 20 is not fixed to lower receiver 80. As illustrated, the upper portion of spring latch 200 is pressed against a side wall of the magazine well 105. The side wall of magazine well 105 exerts a force on spring latch 200 such that the upper portion of spring latch 200 is deflected from its at rest position, and is therefore in a stressed position. In addition, the force causes an effective width of magazine 20 to be less than an effective width of the magazine well 105.

Figure 8:
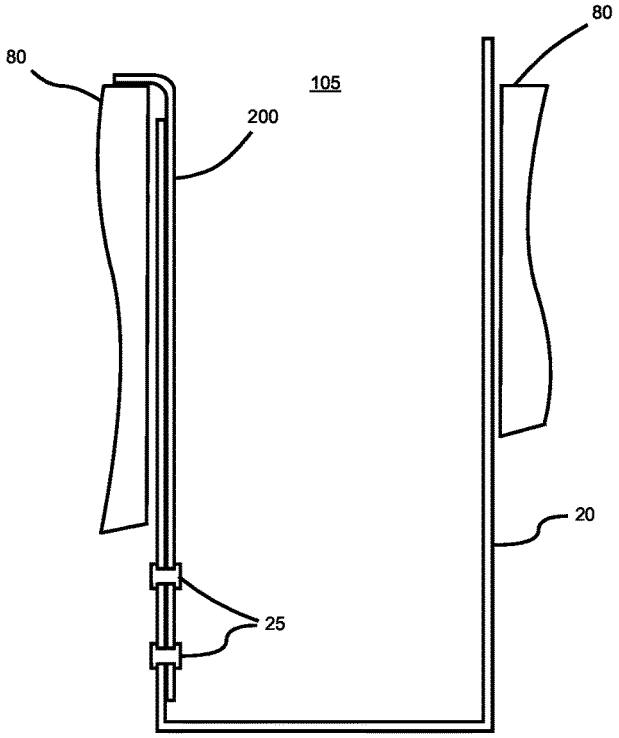
FIG. 8 is a cross-sectional view of a magazine well of a lower receiver having a magazine inserted therein according to some embodiments.

FIG. 8 is a cross-sectional view of magazine well 105 of lower receiver 80 of firearm 100 having magazine 20 inserted therein according to some embodiments. For clarity, magazine 20 is illustrated without a follower and a magazine spring, which are discussed below with reference to FIG. 14.

At the illustrated amount of insertion, magazine 20 is inserted into the magazine well 105, and magazine 20 is fixed to lower receiver 80. As illustrated, the upper portion of spring latch 200 is not pressed against the side wall of the magazine well 105 as illustrated in FIG. 7. Accordingly, the side wall of magazine well 105 does not exert a force on spring latch 200 causing the upper portion of spring latch 200 deflect from its at rest position. Instead, the top portion of spring latch 200 engages an upper portion of lower receiver 80. As illustrated, spring latch 200 is closer to its at rest position than illustrated in FIG. 7. In some embodiments, in the position illustrated in FIG. 8, spring latch 200 is in its at rest position.

Because the upper portion of spring latch 200 engages the upper surface of lower receiver 80, spring latch 200 causes magazine 20 to be fixed to lower receiver 80. Accordingly, spring latch 200 resists or prevents detachment of magazine 20 from lower receiver 80 in response to a force applied to magazine 20 relative to lower receiver 80.

In order to remove magazine 20 from lower receiver 80, an operator of lower receiver 80 may access spring latch 200, for example by breaking the action of firearm 100 or disengaging or partially disengaging lower receiver 80 from the remaining portion of firearm 100. Once accessed, the operator may manipulate spring latch 200, for example, with a hand, a finger, or a tool, to cause the illustrated portion of spring latch 200 to disengage from the upper surface of lower receiver 80. For example, the operator may deflect spring latch 200 such that the upper portion of spring/200 disengages from the upper surface of lower receiver 80. Once thusly deflected, spring latch 200 no longer prevents magazine 20 from detaching from lower receiver 80, and magazine 20 may be removed from lower receiver 80. When the magazine 20 is partially removed, the position relationships among magazine 20, spring latch 200, and magazine well 105 may be represented by FIG. 7.

The corresponding effective width of the magazine well 105 may, for example, be equal to the length of a first line inside magazine well 105 perpendicular to the illustrated portions of lower receiver 80 bounding the magazine well 105. The effective width of the magazine 20 may, for example, be the length of a second line parallel to the first line and terminating at locations perpendicular to left and right extremes of magazine 20 (including spring latch 200), as illustrated in FIGS. 7 and 8. The corresponding effective width of the magazine well 105 and the effective width of the magazine 20 may each be defined using other geometric constructions. In some embodiments, the corresponding effective width of the magazine well 105 and the effective width of the magazine 20 are defined so that, if the effective width of the magazine 20 is less than the corresponding effective width of the magazine well 105, the magazine 20 will fit into the magazine well 105, and if the effective width of the magazine 20 is greater than the corresponding effective width of the magazine well 105, the magazine 20 will not fit into the magazine well 105.

Figure 9:
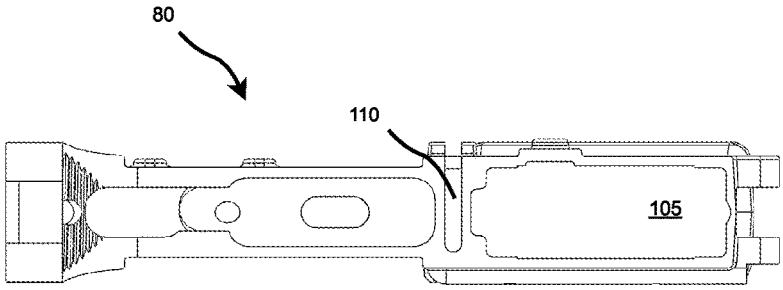
FIG. 9 is a top-down view of a receiver according to some embodiments.

FIG. 9 is a top-down view of lower receiver 80 according to some embodiments. Magazine well 105 is illustrated and indicated. In addition, bolt catch slot 110 is also illustrated and indicated. When firearm 100 is assembled, a bolt catch (not shown) may be movably attached to lower receiver 80 so that the bolt catch can rotatably move within bolt catch slot 110, for example, to restrict movement of the bolt of firearm 100 after the last round of magazine 20 has been fired, as understood by those of skill in the art before and/or after understanding various aspects of the present disclosure.

Figure 10:
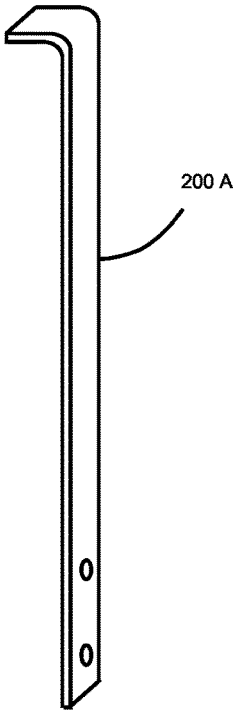
FIG. 10 is a perspective view of a spring latch of a magazine according to some embodiments.

FIG. 10 is a perspective view of a spring latch 200 A of magazine 20 according to some embodiments.

Figure 11:
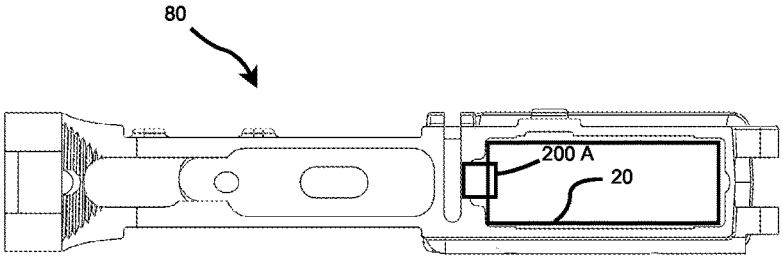
FIG. 11 is a top-down view of a receiver having a magazine in a magazine well of the receiver according to some embodiments.

FIG. 11 is a top-down view of receiver 80 having magazine 20 inserted therein according to some embodiments. As illustrated, magazine 20 is inside the magazine well 105 of receiver 80. In addition, the top portion of spring latch 200 A is shown. Comparison of lower receiver 80 as illustrated without magazine 20 (FIG. 9) with lower receiver 80 as illustrated with magazine 20 (FIG. 10) shows that the top portion of spring latch 200 A is in the position illustrated in FIG. 8. Accordingly, part of the top portion of spring latch 200 A is over a top surface of receiver 80. As discussed above, with the magazine 20 in this position, magazine 20 is fixed to lower receiver 80.

As understood by those of skill in the art before and/or after understanding various aspects of the present disclosure, when the spring latch 200 A is in the position illustrated in FIG. 11, the bolt catch (not shown) may be pressed against the top portion of spring latch 200 A by a spring (not shown), for example, when the bolt catch is in a position which does not restrict movement of the bolt of firearm 100.

Figure 12:
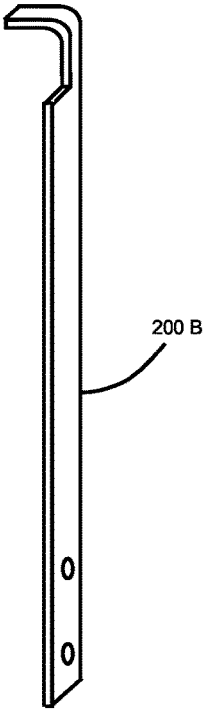
FIG. 12 is a perspective view of a spring latch of a magazine according to some embodiments.

FIG. 12 is a perspective view of a spring latch 200 B of magazine 20 according to some embodiments.

Figure 13:
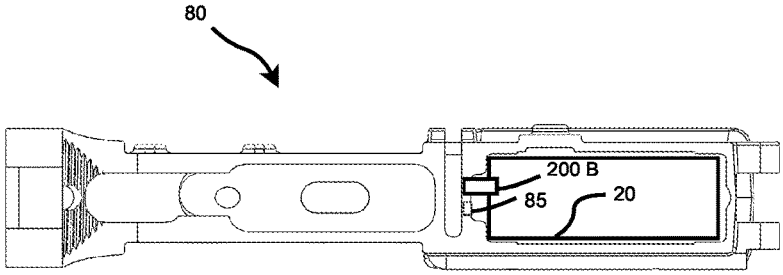
FIG. 13 is a top-down view of a receiver having a magazine in a magazine well of the receiver according to some embodiments.

FIG. 13 is a top-down view of receiver 80 having magazine 20 inserted therein according to some embodiments. As illustrated, magazine 20 is inside the magazine well 105 of receiver 80. In addition, the top portion of spring latch 200 B is shown. Comparison of lower receiver 80 as illustrated without magazine 20 (FIG. 9) with lower receiver 80 as illustrated with magazine 20 (FIG. 12) shows that the top portion of spring latch 200 B is in the position illustrated in FIG. 8. Accordingly, part of the top portion of spring latch 200 B is over a top surface of receiver 80. As discussed above, with the magazine 20 in this position, magazine 20 is fixed to lower receiver 80.

As understood by those of skill in the art before and/or after understanding various aspects of the present disclosure, when the spring latch 200 B is in the position illustrated in FIG. 13, the bolt catch (not shown) may be pressed against a top portion 85 of receiver 80 by a spring (not shown), for example, when the bolt catch is in a position which does not restrict movement of the bolt of firearm 100. In addition, because the spring latch 200 B does not occupy the top portion 85 of receiver 80, when the spring latch 200 B is in the position illustrated in FIG. 13, the bolt catch is not pressed against the top of spring latch 200 B. Accordingly, the spring latch 200 B does not affect the range of motion of the bolt catch.

In some embodiments, an operator may insert a conventional magazine in magazine well 105, and operate firearm 100 according to principles understood by those of skill in the art before and/or after understanding various aspects of the present disclosure. In addition, the operator may remove the conventional magazine, for example, at least in part by activating magazine release mechanism 50. The operator may subsequently insert an embodiment of magazine 20, and again operate firearm 100 according to principles understood by those of skill in the art before and/or after understanding various aspects of the present disclosure. In addition, the operator may remove the embodiment of magazine 20 by, at least in part, accessing and manipulating the top portion of spring latch 200, as discussed elsewhere herein. The operator may subsequently insert a conventional magazine in magazine well 105, and operate firearm 100 according to principles understood by those of skill in the art before and/or after understanding various aspects of the present disclosure.

In some embodiments, an operator may use an embodiment of magazine 20 with a lower receiver 80 according to a method including one or more or all of:

- orienting magazine 20 relative to lower receiver 80 such that the upper portion of spring latch 200 is within the magazine well 105;
- causing the upper portion of spring latch 200 to engage a side wall of the magazine well 105, for example, as illustrated in FIG. 7;
- pressing the upper portion of spring latch 200 against the side wall such that the spring latch 200 flexes to a stressed position, whereby an effective width of the magazine 20 becomes less than a corresponding width of the magazine well 105, whereby the magazine 20 fits into the magazine well 105, for example, as illustrated in FIG. 7;
- orienting magazine 20 relative to the magazine well 105 such that the side walls of the magazine well 105 are substantially parallel with sidewalls of magazine 20, for example, as illustrated in FIGS. 7 and 8;
- applying a force to the magazine 20 relative to the lower receiver 80 to cause the magazine 20 to be inserted into the magazine well 105, for example, as illustrated in FIG. 7;
- continuing to apply the force to the magazine 20 to cause the upper portion of spring latch 200 to cease engaging the side wall of magazine well 105, for example, as illustrated in FIG. 8;
- causing the upper portion of spring latch 200 to engage an upper surface of lower receiver 80, for example, as illustrated in FIG. 8;
- continuing to apply the force to the magazine 20 to cause the spring latch 200 to be in a relaxed state, for example, as illustrated in FIG. 8;
- causing the magazine 20, while inserted in magazine well 105, to have an effective width which is greater than the corresponding width of the magazine well 105, whereby the magazine 20 is secured to lower receiver 80 by the spring latch 200;
- accessing the upper portion of spring latch 200 while the magazine 20 is inserted in the magazine well 105;
- applying a force to the upper portion of spring latch 200, for example, with a hand without a tool, or with a tool, whereby the spring latch 200 is caused to be in a stressed or more stressed state;
- after the magazine 20, while inserted in magazine well 105, has had an effective width which is greater than the corresponding width of the magazine well 105, causing the magazine 20, while inserted in magazine well 105, to have an effective width which is less than the corresponding width of the magazine well 105, whereby the magazine 20 is no longer secured to lower receiver 80 by the spring latch 200;
- actuating a magazine release mechanism 50 of lower receiver 80; and
- applying a force to the magazine 20 relative to the lower receiver 80 to cause the magazine 20 to be removed from the magazine well 105.

Figure 14:
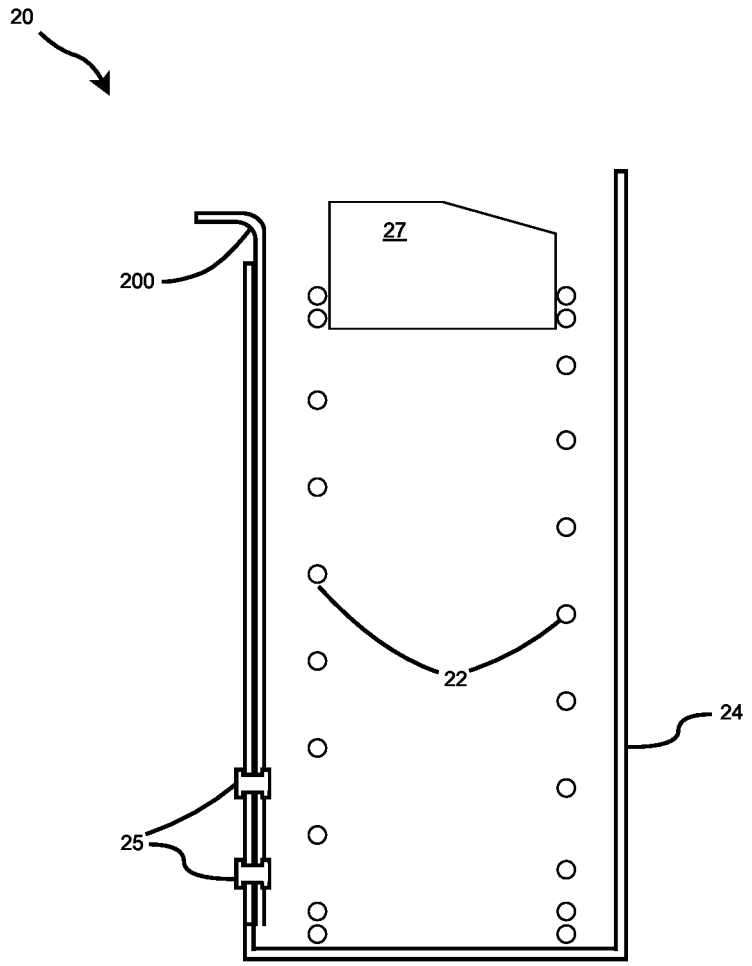
FIG. 14 is a cross-sectional diagram of magazine illustrating a follower and a magazine spring inside the body of the magazine.

FIG. 14 is a cross-sectional diagram of magazine 20, where magazine 20 is illustrated with a follower 27 and a magazine spring 22 inside body 24. The magazine spring 22 is illustrated as a series of cross-sections of a coiled wire forming magazine spring 22, where the illustrated cross-sections are connected as a single magazine spring, as understood by those of skill in the art before and/or after understanding various aspects of the present disclosure. Magazine 20 also includes spring latch 200, attached to body 24 by fasteners 25.

In the illustrated embodiment, follower 27 is fixed to a top portion of magazine spring 22. To load the magazine 20, ammunition is fed into the body 24 through an opening at the top of the body 24. As the ammunition is fed into the body 24, the follower is pressed toward the bottom of body 24, causing the magazine spring 22 to compress. As each round of ammunition is removed from the magazine 20, the magazine spring 22 presses against follower 27, exerting a force which causes any additional rounds above the follower 27 to move up.

There is sufficient clearance between the spring latch 200 and the magazine spring 22 to allow for each of the spring latch 200 and the magazine spring 22 to not interfere with one another as they each function as described. There is sufficient clearance between the spring latch 200 and the follower 27 to allow for each of the spring latch 200 and the follower 27 to not interfere with one another as they each function as described. There is sufficient clearance between the spring latch 200 and the space occupied by ammunition above the follower 27 to allow for each of the spring latch 200 and the rounds above the follower 27 to not interfere with one another as they function as described.

Accordingly, the magazine 20 may be inserted into the magazine well of the firearm and automatically lock securely into the weapon with a spring latch. Once sufficiently inserted, the magazine 20 functions to feed ammunition to the firing mechanism of the weapon, as understood by those of skill in the art before and/or after understanding various aspects of the present disclosure. To remove magazine 20, for example, once all of the ammunition stored in the magazine 20 has been fed to the firing mechanism of the weapon, the weapon must be disassembled or partially disassembled to release the spring latch.

The spring latch may include a small piece of spring steel or other compliant material which interfaces with a top surface of a lower receiver near the bolt catch attached to the lower receiver. To remove the magazine 20, in some embodiments, the action of the weapon is broken to expose a portion of the spring latch, and a tool may be used to release the spring latch, for example by prying the spring latch away from the top surface of the lower receiver while simultaneously pressing a magazine release button of a magazine release mechanism. In some embodiments, only after this has been done, the magazine 20 can be extracted from the weapon.

The spring latch can be installed on any type of weapon magazine. For example, the spring latch may be attached to a magazine by two substantially flush mounted rivets down the vertical rear spine of the magazine. Other attachment mechanisms may be used. In some embodiments, the spring latch is installed on previously manufactured complete magazines. Accordingly, the spring latch may be installed as an after market addition to a magazine.

The magazine 20 of the application can be used to convert firearm types and functions. For example, installing the magazine 20 may convert the weapon from a detachable magazine 20 weapon to a fixed magazine 20 weapon. The magazine 20 can be used by anybody at any time to change the classifications or capabilities of a firearm.

The magazine 20 can be installed without tools at substantially the same speed at which a standard magazine may be inserted. For example, to install the magazine 20, the spring latch may be pressed against an inner wall of the magazine 20 well of the lower receiver such that the spring latch deflects and the magazine 20 fits into the magazine 20 well. The magazine 20 is then pressed into the well as the spring latch slides along an inner side wall. When properly seated, the magazine 20 is held in place by the spring latch engaging an upper surface of the lower receiver, such that the magazine 20 cannot be removed until the spring latch is deflected so as to not engage the upper surface of the lower receiver. In some embodiments, a magazine retention mechanism is also manipulated, for example, with a magazine release button, to release the magazine 20.

The spring latch may be made from spring steel plate. The spring latch may be mounted to the inside of the magazine 20 with one or two or more fasteners. The hook or top portion of the spring latch at the top side of the spring latch protrudes from the rear of the magazine 20 and locks the magazine 20 in place when fully inserted into the weapon magazine well. Upon insertion, the spring latch is compressed and may slide along an inner wall of the magazine well as it travels through the magazine well of the weapon. When the magazine 20 reaches its seated or locked position, the spring latch deploys rearward and comes to rest over an upper surface of the lower receiver. For example, the spring latch may come to rest over a top surface of the lower receiver underneath the bolt catch.

The spring latch may be mounted to the inside of a vertical channel of the magazine 20. For example, the magazine 20 may be formed or modified to have one or more hardware mounting hole(s) through the magazine 20 wall to secure the spring latch to the magazine 20. The vertical position of the mounting hole(s) may be such that the hook on the top of the spring engages the top face of the lower receiver (or alternative) after the magazine 20 is seated in the lower receiver. When the magazine 20 is being inserted into the magazine well, the spring is deflected toward the center of the mag well. Once the magazine 20 is seated, the tab or upper portion of the spring latch at the top end of the spring latch will latch onto the top surface of the lower receiver. The tab may finds its seated position under the bolt catch and above the lower receiver. The spring latch may be manufactured, for example, from CRES corrosion resistant spring steel or plated carbon spring steel. The surface of the spring latch may be smooth and corrosion free to allow smooth feeding into the magazine 20 well of the lower receiver.

The magazine 20 may lock into the weapon when inserted. The magazine 20 may change the classification of the weapon and its purpose. The magazine 20 may be removable only by disassembling or partially disassembling the weapon. The magazine 20 may function with a variety of different weapons.

While various aspects, processes, actions, and systems have been described as being included in the embodiments discussed, the various aspects, processes, actions, and systems can be practiced with certain modifications. For example, the sequential order of the various aspects, processes, and actions may be modified. In addition, certain aspects, processes, and actions may be omitted, and other aspects, processes, and actions may be added.

Though the present invention is disclosed by way of specific embodiments as described above, those embodiments are not intended to limit the present invention. Based on the methods and the technical aspects disclosed above, variations and changes may be made to the presented embodiments by those skilled in the art without departing from the spirit and the scope of the present invention.

What is claimed is:

1. A method of using an ammunition feeding device, the ammunition feeding device comprising a body, a follower inside the body, a magazine spring contacting the follower, and a spring latch attached to the body, wherein the spring latch extends from a position inside the body to a position outside the body through an opening in the top of the body, wherein the method comprises:

orienting the ammunition feeding device such that a portion of the spring latch is within a magazine well of a lower receiver;

causing the portion of the spring latch to engage a side wall of the magazine well;

pressing the portion of the spring latch against the side wall such that the spring latch flexes to a stressed position; and applying a force to the ammunition feeding device relative to the lower receiver to cause the ammunition feeding device to be fixed to the lower receiver.

2. The method of claim 1, wherein the lower receiver is a component of an assembled firearm.

3. The method of claim 1, wherein pressing the portion of the spring latch against the side wall of the magazine well causes an effective width of the ammunition feeding device to become less than a corresponding width of the magazine well, whereby the ammunition feeding device fits into the magazine well.

4. The method of claim 1, wherein applying the force to the ammunition feeding device relative to the lower receiver causes the portion of the spring latch to cease engaging the side wall of the magazine well.

5. The method of claim 1, wherein applying the force to the ammunition feeding device relative to the lower receiver causes the portion of the spring latch to engage an upper surface of lower receiver, wherein the upper surface of lower receiver is substantially perpendicular to the side wall.

6. The method of claim 1, wherein applying the force to the ammunition feeding device relative to the lower receiver causes the spring latch to be in a substantially relaxed state.

7. The method of claim 1, wherein applying the force to the ammunition feeding device relative to the lower receiver causes the ammunition feeding device to have an effective width which is greater than the corresponding width of the magazine well, and wherein the ammunition feeding device is fixed to the lower receiver because the effective width of the ammunition feeding device is greater than the corresponding width of the magazine well.

8. A method of using an ammunition feeding device, the ammunition feeding device comprising a body, a follower inside the body, a magazine spring contacting the follower, and a spring latch attached to the body, wherein the spring latch extends from a position inside the body to a position outside the body through an opening in the top of the body, wherein the method comprises:

accessing a portion of the spring latch outside the body of the magazine while the magazine is within a magazine well of a lower receiver;

applying a force to the portion of the spring latch, whereby the spring latch is caused to be in a stressed or more stressed state;

causing the portion of the spring latch to engage a side wall of the magazine well; and applying a force to the ammunition feeding device relative to the lower receiver to cause the ammunition feeding device to exit the lower receiver.

9. The method of claim 8, wherein the lower receiver is a component of an assembled firearm.

10. The method of claim 9, wherein accessing the portion of the spring latch outside the body of the magazine comprises disassembling or partially disassembling the firearm.

11. The method of claim 8, wherein applying the force to the portion of the spring latch causes an effective width of the ammunition feeding device to become less than a corresponding width of the magazine well.

12. The method of claim 8, wherein applying the force to the portion of the spring latch comprises using a tool.

13. The method of claim 8, wherein applying the force to the portion of the spring latch causes the ammunition feeding device to no longer be secured to the lower receiver by the spring latch.

14. The method of claim 8, further comprising actuating a magazine release mechanism of the lower receiver.

15. The method of claim 8, wherein the spring latch is configured to be in first and second positions according to a force applied thereto, wherein in the first position, the ammunition feeding device has a first effective width, wherein in the second position, the ammunition feeding device has a second effective width, and wherein the first effective width is greater than the second effective width.

* * * * *